US006916979B2

(12) United States Patent
Raisanen

(10) Patent No.: US 6,916,979 B2
(45) Date of Patent: Jul. 12, 2005

(54) ELECTROMECHANICAL TRANSDUCER AND METHOD FOR MANUFACTURING AN ELECTROMECHANICAL TRANSDUCER

(75) Inventor: Heikki Raisanen, Jyvaskyla (FI)

(73) Assignee: Emfitech Oy, Vaajokoski (FI)

( * ) Notice: Subject to any disclaimer, the term of this patent is extended or adjusted under 35 U.S.C. 154(b) by 21 days.

(21) Appl. No.: 10/464,058

(22) Filed: Jun. 18, 2003

(65) Prior Publication Data

US 2004/0051420 A1 Mar. 18, 2004

Related U.S. Application Data

(63) Continuation of application No. PCT/FI01/01125, filed on Dec. 19, 2001.

(30) Foreign Application Priority Data

Dec. 19, 2000 (FI) ..... 20002780

(51) Int. Cl.[7] ..... G10H 3/18
(52) U.S. Cl. ..... 84/731
(58) Field of Search ..... 84/724, 730, 731

(56) References Cited

U.S. PATENT DOCUMENTS 3,632,443 A 1/1972 Kodera et al.
4,250,415 A 2/1981 Lewiner et al.
4,400,634 A 8/1983 Micheron
4,654,546 A 3/1987 Kirjavainen
5,955,014 A 9/1999 Raukola et al.
6,078,006 A 6/2000 Raisanen et al.
6,242,683 B1 * 6/2001 Raisanen et al. ..... 84/733

FOREIGN PATENT DOCUMENTS

| | | |
|---|---|---|
| FI | 105238 | 6/2000 |
| WO | 97/39602 | 10/1977 |
| WO | 96/06718 | 3/1996 |

* cited by examiner

*Primary Examiner*—Jeffrey W Donels
(74) *Attorney, Agent, or Firm*—Katten Muchin Zavis Rosenman

(57) ABSTRACT

Electromechanical transducer element for converting mechanical stress into electrical signals, said transducer comprising: at least one transducer elements (119,120), said element having first and second surfaces; at least one signal electrode layer (209) arranged between two transducer elements, said signal electrode layer being a metal layer arranged in direct contact with first surfaces of the two transducer film elements. Bosses may be arranged adjacent to and/or partly onto at least one electrode layer. The invention relates also to a manufacturing method where adjacent to and/or partly onto a signal electrode and/or a ground electrode a thicker layer of isolating material is deposited, or for composition of the film bosses are arranged in the signal and/or ground electrode.

21 Claims, 7 Drawing Sheets

ELECTROMECHANICAL TRANSDUCER AND METHOD FOR MANUFACTURING AN ELECTROMECHANICAL TRANSDUCER

This application is a Continuation of PCT/FI01/01125 filed Dec. 19, 2001.

FIELD OF INVENTION

The present invention relates to an electromechanical transducer element for converting mechanical stress into electrical signals and, in particular, to an flexible unitary electret film transducer element, and to a method for its fabrication. These kind of transducers can be used for example as pressure, force, acceleration and vibration transducers.

PRIOR ART

As for an electromechanical transducer elements, piezoelectric crystals, piezoelectric sheet (e.g. polyvinylidene fluoride PVDF) and voided electret sheet belong to the prior art. In the commonest film type transducer structures, the metal electrodes are screenprinted silverpaste either on the transducer element or on a plastic film laminated together with transducer element, and connecting cable part is implemented using screened coaxial cable, which is connected to the electrode layers by means of crimped connectors. A drawback with this type of structures is the overall mechanicall strength, and difficulties to implement an integrated structure with necessary preamplifier part.

The electret field, or the permanent electric charge, is achieved by injecting charges into dielectric material.

A dielectric voided electret film and manufacturing process for same, applicable for use as electromechanical material for a transducer, is described in U.S. Pat. No. 4,654,546, said dielectric film comprising permanently charged, biaxially oriented, foamed, usually homogenous film layer containing flat lens-like, shredded or cavitated gas bubbles which can also be called voids or cells. The term "dielectric cellular electret film" is used here to refer to generally voided type electromechanical films having a permanent electric charge injected into material. Voided electret films are highly elastic and compress in thickness under pressure. In dielectric cellular electret film, flat lens-like gas bubbles effectively limit the mobility of electret charges in the dielectric material, because the gases have an electric resistance five decades better than the best solid insulating materials have. At the same time, compared to hard structure of piezoelectric materials, they act as an elastic soft layer during the conversion of vibrations into electric signals allowing pressure variations to cause microscopic changes in its thickness. The change in thickness causes change in capacitance and produces an electrical output voltage in proportion to the force.

WO-publication 96/06718 presents a procedure for pressure inflation of a pre-foamed plastic film, that makes it possible to manufacture strongly foamed film products, involving a high foaming degree and allowing the thickness of the product to be increased without increasing the amount of plastic material. The term "dielectric swelled cellular electret film" is used herein to refer to a foamed film-like plastic product as described in that WO-publication and having a permanent electric charge injected into material.

WO 97/39602 presents a stringed musical instrument transducer for converting string vibrations into electric signals, which transducer is composed of electromechanical sheets and is capable of converting string vibrations into electric signals. The electrodes required by the electromechanical sheet are disposed on the surface of one or more thin and flexible dielectric materials, said electrodes forming electrically conductive surfaces of the transducer for connecting the transducer to a signal processing device, and which transducer is constructed of a unitary, thin and flexible layered sheet structure.

In the transducer described in WO 97/39602, the signal electrode is arranged on the insulate sheet. As it is printed, it becomes typically 20 microns above the level of the insulate sheet. Therefore, when the transducer is under continuous pressure, which is the case in many applications, the transducer element compresses more from the signal electrode area than from the area beside the signal electrode.

SUMMARY OF THE INVENTION

The object of the present invention is to eliminate the drawbacks of prior art and achieve an improved transducer of a completely new type, in which a dielectric swelled cellular electret film is used to transform the mechanical stress into electric signals, and wherein no dielectric firm plastic layer to carry the conductive electrodes will be needed in the transducer structure. Thus the transducer becomes mechanically stronger, thinner and the electrical properties become excellent because the firm plastic layers are not absorbing and dampening the vibration or other mechanical energy. Further, because of saved thickness exclusive firm plastic films, the amount of transducer elements can be increased, without adding too much thickness, and thus the output voltage and therefore the signal-to-noise ratio are further improved. Further, due possible increase in thickness of elastic soft dielectric cellular layers the structure becomes softer. Even further, the electrodes become more durable than screen-printed electrodes and can be easily connected by soldering to the preamplifier or connecting wire instead of using crimped connectors where there are plastic layers in between. Thus the electrical properties of connections become excellent and also more durable. Further, it is possible to simultaneously arrange the screening for the connection and the transducers of the invention are very cost effective to manufacture.

A further object of the invention is to produce a transducer as simple as possible, having no separate transducer part and no separate conductor for connecting it to a signal processing device, but which has a unitary, flexible and laminated structure and in which the connections for connecting it to a preamplifier can be disposed sequentially or side by side and which in itself is able to produce a balanced signal (differential transducer).

The invention relates also to a manufacturing method where adjacent to and/or partly onto a signal electrode and/or a ground electrode is deposited a thicker layer of isolating material, or for compression of the film bosses are arranged in the signal and/or ground electrode whereby the elastic sensor film when the sensor is continuously pressed can during a strong pressure be compressed entirely or at the highest points only. With this construction the sensor generates many times higher voltage under a high pressure than a conventional sensor.

In one embodiment of the invention, an durable and cost effective accelometer type transducer, wherein both the transducer and its preamplifier are arranged on same side of printed circuitry board, is achieved.

The invention is in detail defined in the attached claims.

With the invented manufacturing method, it is possible to produce ultra thin and flexible transducers of desired length, design and width, in which the electrodes in the transducer part are continuous extending from the transducer part to the preamplifier and which are unitary, flexible and thin laminate in construction. Fabrication is faster and more economic than with conventional methods.

The structure of the invention thus allows the application of an effective and economic production technique with significantly improved electrical properties.

BRIEF DESCRIPTION OF THE DRAWINGS

In the following, the invention is described in more detail by the aid of examples by referring to the attached drawings, in which.

DETAILED DESCRIPTION

Figure 1A:
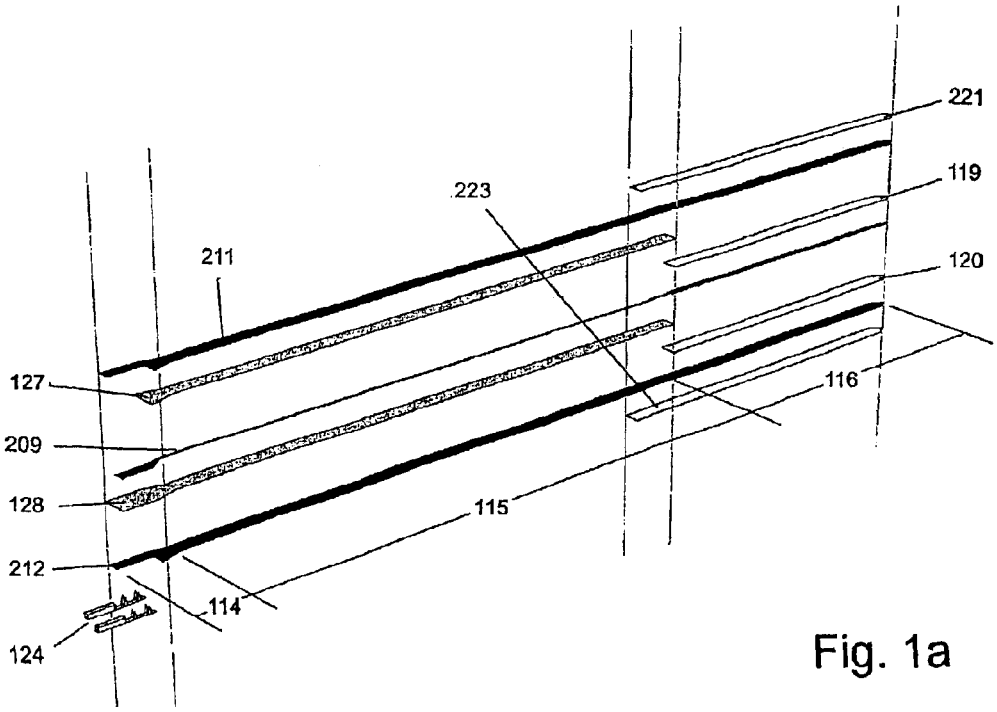
FIG. 1*a* presents an exploded perspective view illustrating the different components that comprise the transducer of the invention without extra dielectric layers carrying the electrodes at the transducer area, with connectors in preamplifier end arranged side by side.
Figure 1B:
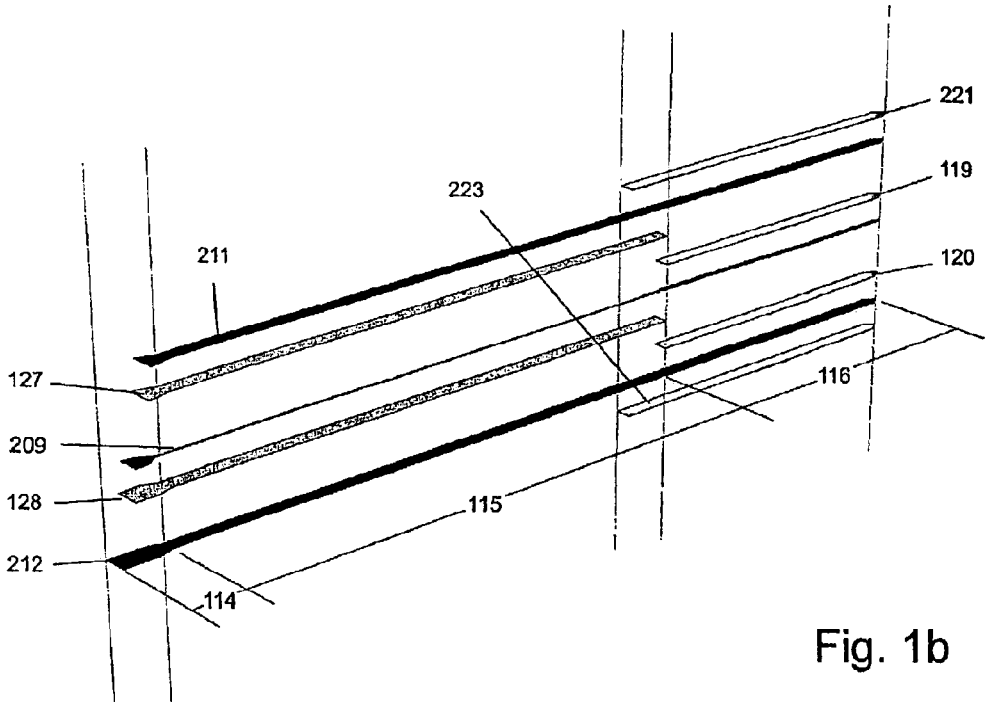
FIG. 1*b* presents an exploded perspective view illustrating the different components that comprise the transducer of the invention without extra dielectric layers carrying the electrodes at the transducer area, with sequentially arranged connecting areas. in preamplifier end.

The transducers of invention in FIGS. 1*a* and 1*b* consists of a connector part 114 including connectors connecting the transducer to a preamplifier, a connection part 115 corresponding to a connection cable in a conventional transducer and a transducer part 116 for converting the vibrations into electric signals. As may be noted the transducers in FIGS. 1*a* and 1*b* have no separate transducer part and no separate conductor for connecting it to a signal processing device, but are of a unitary, flexible and laminated structure extending from the end of transducer part 116 unitary as a connection part 115 up to the connector part 114 and in which the connections for connecting it to a preamplifier can be disposed in sequentially or side by side.

Referring now to FIG. 1*a*, signal electrode 209 is a thin metal film, for example tinbronze-alloy or tinned copper with thickness of preferably 0.035 up to 0.1 mm. It is to be noted that many thin metal films and thickness are suitable for the application.

Figure 5:
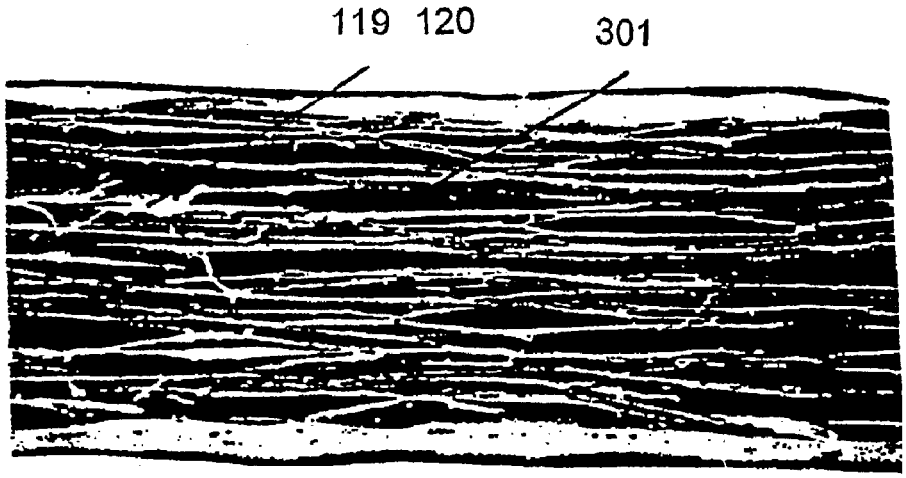
FIG. 5 presents a microscope picture of dielectric cellular electret bubble film.

On both sides of the signal electrode 209 there are swelled dielectric cellular electret films 119, 120 having flat gas bubbles 301 (FIG. 5), and on the outer sides of the cellular electret films 119, 120, ground electrodes 211, 212. Signal electrode 209 has a form where the electrode is broad in the transducer part and narrow in the connection part. In the connector part the signal electrode has an area corresponding the connection area of the connector 124. Ground electrodes 211, 212 each comprises of thin metal film. Both the ground electrodes 211, 212 are connected together with a connector 124 in the connector part 114.

Cellular electret films 119, 120 in the transducer area may each comprise of several film layers. Each film 119, 120 is charged. Preferably positive charges are injected onto the underside of sheet 119 and onto the top side of sheet 120. Negative charges may be injected onto the top side of sheet 119 and onto the underside of sheet 120 but it is not essential. The films 127, 128 in the connection part are preferably uncharged operating thus as isolating film layers between the electrodes. It is also possible to extend the cellular electret films 119, 120 all the way to the connector part 114 but preferably use only partially charged film so that there is no charges in the connection part 115, to avoid the connection part become active. The ground electrodes 211, 212 can also be sputtered, evaporated or chemically metallized to the outer sides of the bubble films 119, 120. It is also possible to arrange the signal electrode 209 directly on the face of bubble film 119 or 120 by for example chemical metallizing process or screenprinting. In this embodiment, to increase the output voltage, it is also possible to use two, or even more, signal electrodes 209 by using three or more transducer elements 119–120 and in between each said element having one signal electrode 209 and at the outermost faces of the outermost transducer elements having the ground electrodes 211–212. Further, by using two signal electrodes, two ground electrodes and three transducer elements, and having the two signal electrodes in connection part arranged side-by-side, an differential transducer can be obtained.

The outermost film layers 221, 223 are not essential for the transducers operation but in some embodiments of the invention, they can act as extra elastic layer in between the vibrating members or as insulation layer for example against printed circuitry board.

Figure 4:
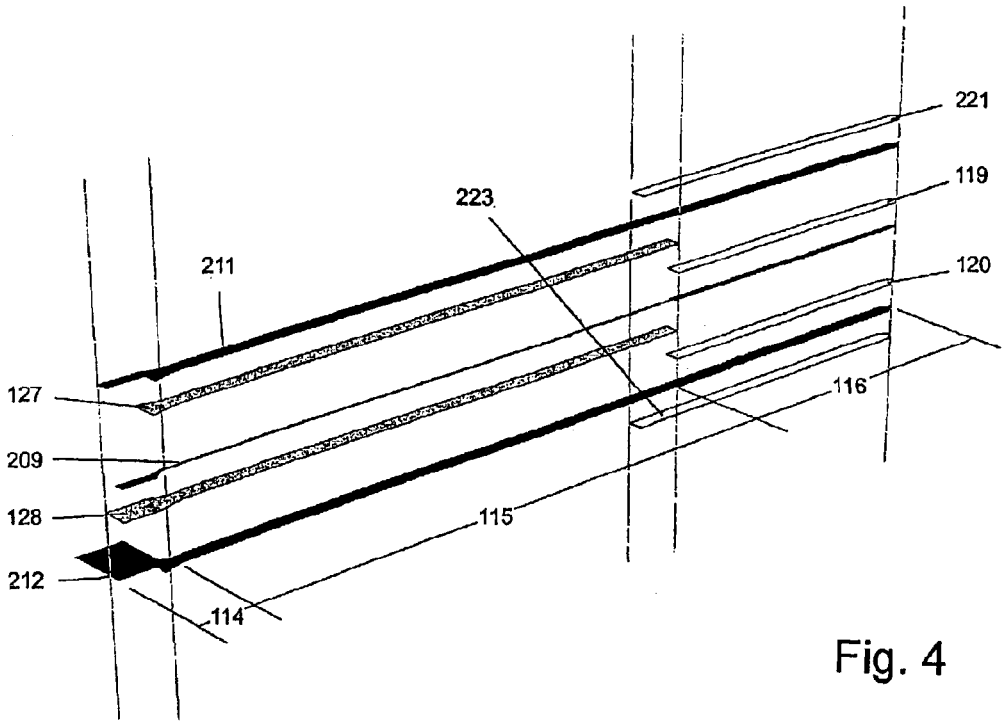
FIG. 4 presents an exploded perspective view illustrating the possible screening of the connector end.

FIG. 4 shows how the ground electrode 211 may have an extension 224 on the side to form shielding against electrical interference in the connector end 114. Because the connector area in the signal electrode is open for electromagnetic interference, it must be shielded. Typically this is taken care by metal housing of the preamplifier circuitry, but by this way, an very small preamplifier circuitry can be integrated into the connector end. The components of the circuitry, preferably one field-effect (FET) transistor and one resistor, are connected to the transducers electrodes 209, 211, 212 and the screening extension 224 is folded around the connector end 114 by using double sided tape 226, which also forms the necessary insulating in between the components and extension 224. Leads are connected to the circuitry for taking the signals to the amplifier. By having the preamplifier circuitry as close as possible to the transducer unit, the capacitance of the connection part is lowest possible and the signal-to-noise ratio becomes significantly better.

Figure 2:
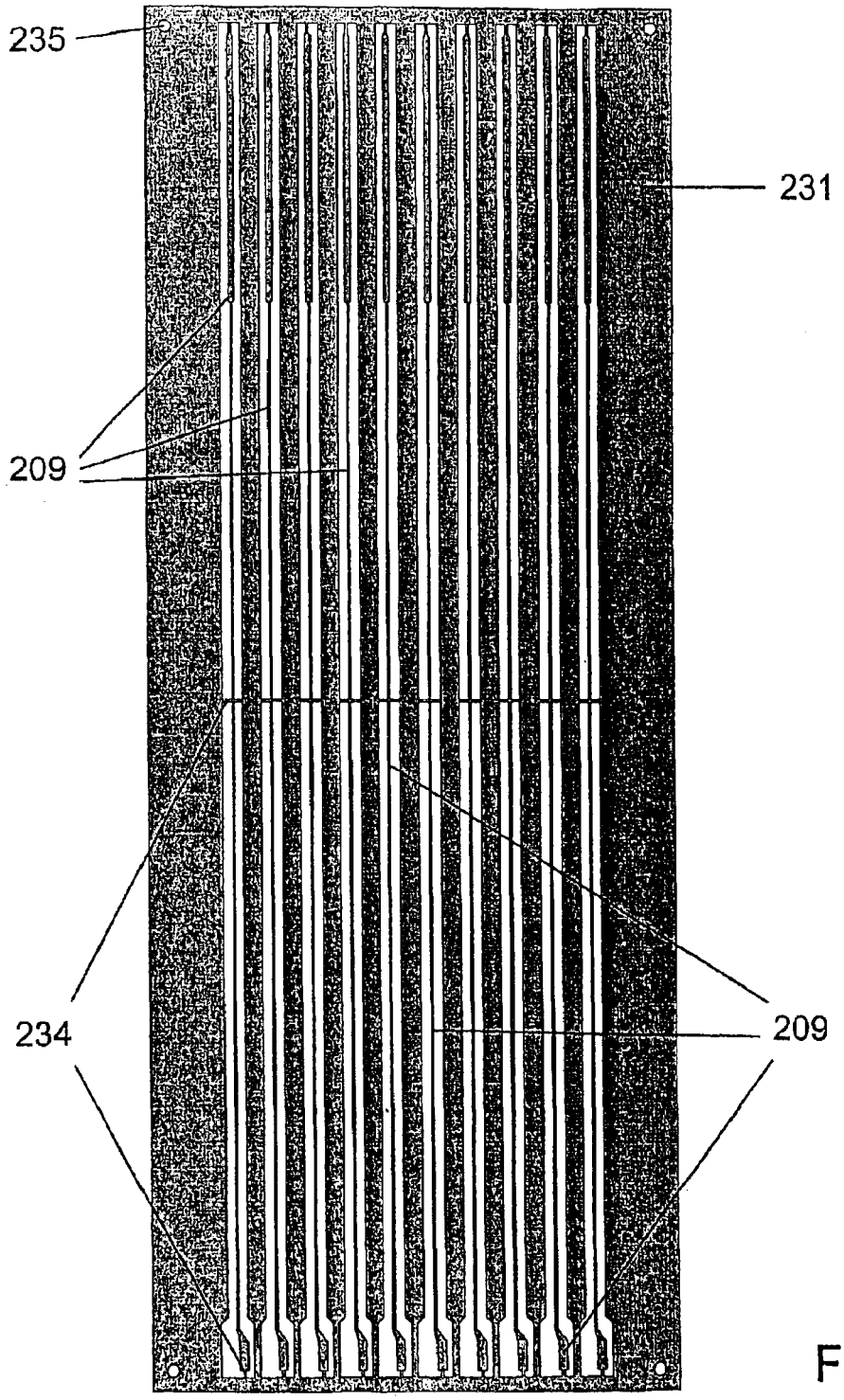
FIG. 2 presents the signal electrodes of the transducer of the embodiment in FIG. 1*a,*
Figure 3:
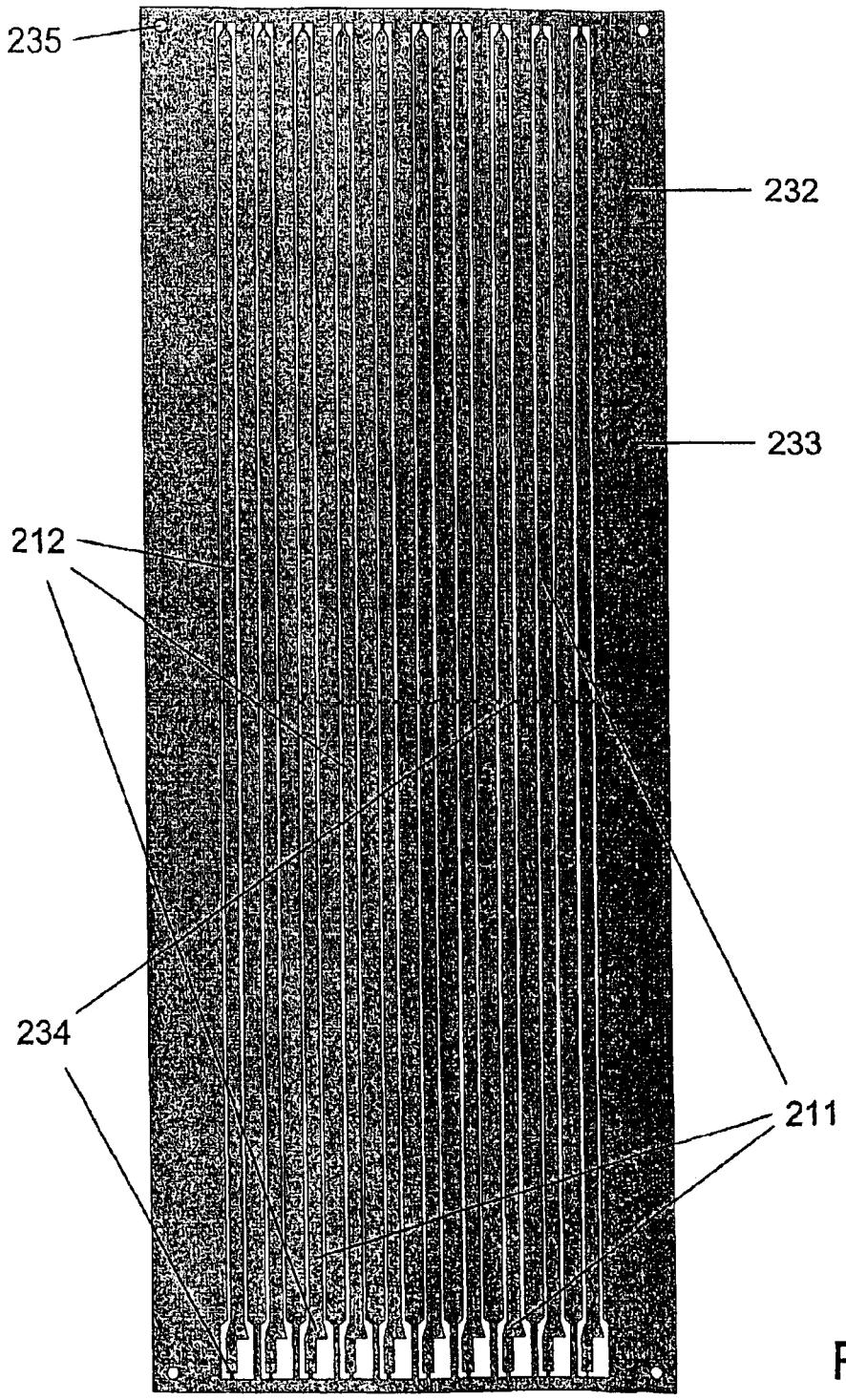
FIG. 3 presents one side ground electrodes of the transducer of the embodiment in FIG. 1*a,*

The transducers in FIGS. 1*a* and 1*b* and 4 are fabricated as follows:

Referring to FIG. 2 signal electrodes 209 and ground electrodes 211, 212 are made of a thin metal film 231, 232, 233. Firstly the thin metal film 231, 232, 233 is screen-printed both sides with an insulating material in the areas to form the electrodes. Secondly the metal films 231, 232, 233 are taken into chemical corrode process where all metal except the areas coated with insulating material, is corroded away. Thirdly, the metal film is taken into next chemical process, where the insulating material is removed for example with alkaline solution. After this, a metal film 231, 232, 233, where the wanted electrodes are connected to each others and frame surrounding them with very narrow keepers 234, is remained. In the corners of each metal film 231, 232, 233 there is a hole 235 to ease the assembly. It is to be noted that there is other ways too to make similar metal film 231, 232, 233 containing electrodes for several transducers and with keepers connected to each others and frame. One way is to laser cut the same pattern from a metal film, other way is die-cutting the metal film with suitable tool having the same pattern. Water cutting can also be used.

Cellular electret film elements 119, 120 size large enough, consisting typically a laminate of 1–3 dielectric cellular electret films, preferably swelled, and metal films 231, 232, 233 are glued together so that first against metal film 232 with ground electrodes, transducer element 119 and insulating layer 127 are glued, and next, on the other side of the transducer element 119 and insulating layer 127, the metal film 231 with signal electrodes is glued, and next, to the other side of metal film 231, second transducer element 120 and second insulating layer 128 are glued, and next, on the other sides of the transducer element 120 and insulating substrate 128, metal film 233 with second ground layers is glued. In this way a laminate is obtained from which the transducers can be cut away by for example by die-cutting, laser cuffing or water cutting. Further the connectors 124 can be connected by pressing them to connector end 114.

Figure 7:
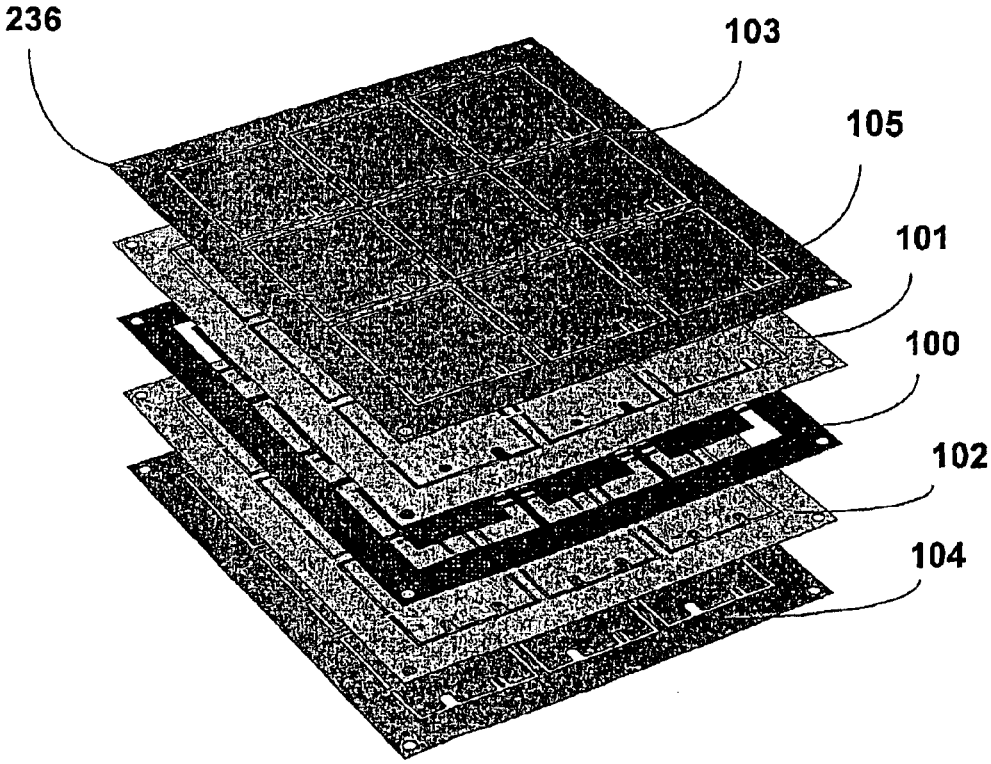
FIG. 7 presents an exploded perspective view illustrating a net of different components from which the components, that comprise a second type of a transducer according to the invention, are achieved.

It is also possible first to lay a sheet of glue on both sides on a sheet of dielectric cellular film. Such thin, typically 50 microns thick, glue sheets are manufactured for example by 3M. Obtained sheet of dielectric cellular film 101 (FIG. 7) with glue covered by silicon papers is further diecut to form a suitable pattern with metal electrodes 100, 103, 104 including holes 236. This sheet is further first glued, for example against the net of ground electrodes 103 by removing the silicone paper from the areas to come against ground electrode and holes 236 in align. All extra material is removed after glueing.

Figure 6:
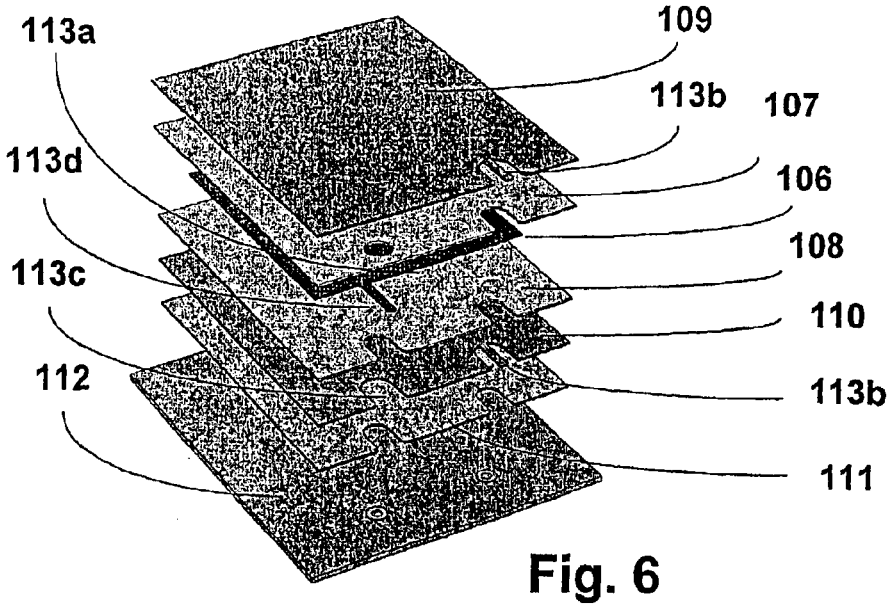
FIG. 6 presents an exploded perspective view illustrating the different components that comprise another type of a transducer according to the invention.

Next, the silicone paper on the other side of the electret film is removed and the net 100 forming the signal electrodes is installed against metal net 100 with holes 236 in align. Further another sheet of electret film 102, with glue sheets on both sides covered with silicone paper, and diecut to suitable form, is glued against the the net of signal electrodes 100 by first removing the silicone paper from the areas to come against the signal electrodes. The last is to attach the second net 104 of ground electrodes against it. Further it is possible for attaching the sensor to PCB board, have a suitable glue sheet first diecut to form a suitable pattern and attached it to this of transducers, as can be seen in FIG. 6. By this way, a sheet containing several transducers side by side is obtained, from which separate transducers can easily be removed because the net is hold together by only tiny keepers 105, which are easily cut when pressed. Transducers are very well screened, cheap to manufacture, reliable to connect to preamplifier, and good in perform.

The sensors have very good output because two electret film sheets 107, 108 are connected in parallel to signal electrode, as referred in FIG. 6. Further the pattern can be made such that signal electrode 106 has edges 113*a* arranged wholly inside the sensor structure in order to get a disturbance-free signal output, and the ground electrodes 109, 110 have small extensions 113*b*, and other ground electrode 110 has opening 113*c* for an extension 113*d* at the signal electrode 106. The extensions 113*b*, 113*d* can be bent 90 degrees and soldered directly to holes in a PCB board 112 after the sensor is first glued against it. Because the outer ground electrode 110 is arranged with a pattern where there is no hole for extension 113*d* at the signal electrode 106, it becomes completely shielded against electromagnetic interference from that side. The PCB can have the necessary components for preamplifier and there may be an isolating layer 111 between the PCB 112 and ground electrode 110. PCB can be same size as sensor and have the components on the other side or it can be larger and components can be on the same side as the transducer. If the transducer is on the same side as components, it can have a suitable mass added over it to work as accelometer type transducer. If the components are on the opposite side to the transducer, the PCB itself can form the mass for the transducer. It is also possible to exclude the ground electrode 110 and have the ground electrode arranged on the printed circuitry board 112 against which the transducer is applied. For a person skilled in art it is also possible to arrange a differential type transducer with this manufacturing technique, by arranging the screening with other ways for example by metal housing over the printed circuitry board.

In the manufacturing method where adjacent to and/or partly onto a signal electrode and/or a ground electrode is deposited a thicker layer of isolating material, or for compression of the film bosses are arranged in the signal and/or ground electrode whereby the elastic sensor film when the sensor film is less compressed on the points against the bare signal electrode than against the isolation layer which partly can overlap the signal electrode, whereby a sensor elements achieved with a corresponding signal electrode film, and wherein the sensor film against the isolation layer in hard pressure compresses less than in other parts. The isolation can be printed also on corresponding points in the ground electrode, or in the ground electrode only. When printed onto electrode, it can be same material as the electrode, ie. for example silver paste. We have noticed in many experiments, that the output voltage remains much higher with this kind arrangement when the transducer is in continuous high pressure or should withstand continuous high pressure impacts. Thus an improved signal gain is achieved, even two or more times better signal gain can be achieved, and the dynamics and linearity are also improved.

This can be achieved with an etching method described above whereby all the electrode surfaces can be made. Etching can also be realised so that when a certain figure is printed with isolating material on the surface of the metal, and the object is held in the process only a certain defined time, only a part of the metal is corroded (and forms a hollow).

There is multiple applications for this type transducers, for example keyboard switches, even force sensitive, electronic stethoscopes, and musical instruments pickups just to name a few; switches, accelometers and vibration sensors in general.

This procedure allows a considerably larger number of thin, flexible transducers of desired length, width and shape and having a continuous structure without joints than by conventional methods to be fabricated by the same amount of work while the manufacturing costs remain low. Further, referred to the FIGS 1*a* and 1*b*, the transducers can be manufactured very thin without any extra flexible firm insulating substrates to carry the electrodes. Because there is thickness saved due no extra firm insulating substrates, there can be more of active layers, easily 4 layers, which further improves the output voltage and thus also the signal-to-noise ratio.

It is obvious to the person skilled in the art that different embodiments of the invention are not restricted to the examples described above, but that they can be varied within the scope of the claims presented below. The number of films and layers on top of each other can be chosen in accordance with the need in each case and the transducer can also have a shape other than rectangular in top view.

What is claimed is:

1. An electromechanical transducer element for converting mechanical stress into electrical signals, the electromechanical transducer element comprising:

a transducer part having a unitary laminated structure;

at least two transducer film elements disposed in the transducer part, each of the at least two transducer film elements having a first and a second surface;

a signal electrode layer arranged between the at least two transducer film elements, the signal electrode layer comprising a metal layer arranged in direct contact with each of the first surfaces of the at least two transducer film elements;

at least two ground electrode layers, each of the at least two ground electrode layers comprising a metal layer arranged in direct contact with each of the second surfaces of the at least two transducer elements; and wherein the at least two ground electrode layers extend from the transducer part as a connection part, the connection part enabling connecting the transducer part to a signal processing device.

2. The electromechanical transducer element according to claim 1, wherein each of the at least two transducer film elements comprise a permanently charged dielectric elastic electret film.

3. The electromechanical transducer element according to claim 2, wherein the dielectric elastic electret film comprises a biaxially oriented foamed film layer.

4. An electromechanical transducer element for converting mechanical stress into electrical signals, the electromechanical tansducer element comprising:

a transducer part;

a transducer film element disposed in the transducer part, the transducer film element having a first and a second surface;

a first electrode layer comprising a metal layer arranged in direct contact with the first surface of the transducer film element;

a second electrode layer comprising a metal layer arranged in direct contact with the second surface of the transducer film element;

wherein at least one of the first and the second electrode layers is formed from one unitary metal sheet so that a respective plurality of the one of the first and second electrode layers are arranged on the metal sheet; and wherein one of the first and second electrode layers extends from the transducer part as a connection part, the connection part for enabling connecting the transducer part to a printed circuitry board.

5. The electromechanical transducer element according to claim 4, wherein the transducer element comprises a permanently charged dielectric elastic electret film.

6. Transducer according to claim 5, wherein the dielectric elastic electret film comprises a biaxially oriented foamed film layer.

7. An electromechanical transducer for converting mechanical stress into electrical signals, the electromechanical transducer comprising:

transducer film element comprising a signal electrode layer and a ground electrode layer, wherein one of the signal electrode layer and the ground electrode layer comprise a elastic dielectric cellular electret film;

wherein a boss is arranged one of adjacent to and partly onto the one of the signal electrode layer and the ground electrode layer, such that when the transducer film element, is under pressure, the transducer film element is suppressed more in an area of the boss than in another area of the one of the signal electrode layer and the ground electrode layer so that an electrical is improved.

8. A method of forming an electromechanical transducer element for converting mechanical stress into electrical signals, the electromechanical transducer comprising a transducer part having a unitary laminated structure, transducer film element, a signal electrode layer, and a ground electrode layer; the method comprising the steps of:

(a) forming the signal electrode layer and the ground electrode layer from a metal layer;

(b) arranging the signal electrode layer on a first surface of the transducer film element, the signal electrode layer arranged in direct contact with the transducer film element; and (c) arranging the ground electrode layer on a second surface of the transducer film element, the ground electrode layer arranged in direct contact with the transducer film element.

9. The method of forming an electromechanical transducer element according to claim 8, wherein the transducer film element is a charged elastic electret film.

10. The method of forming an electromechanical transducer element according to claim 9, wherein the elastic electret film is a biaxially oriented foamed film layer comprising essentially flat gas bubbles.

11. The method of forming an electromechanical transducer element according to claim 8, wherein the transducer film element further comprises a biaxially oriented foamed film layer comprising essentially flat gas bubbles, and the method further comprising the step of:

(d) swelling the biaxially oriented foamed film layer.

12. The method of forming an electromechanical transducer element according to claim 8, wherein the transducer film element comprising a connector, and the method further comprising the step of:

(d) overlapping the ground electrode over the connector part for forming a shield.

13. The method of forming an electromechanical transducer element according to claim 8, wherein the transducer film element comprising a connector part for connecting, and the method further comprising the step of:

(d) overlapping the ground electrode over the connector part to form a shield for an electronic preamplifier circuitry.

14. A method of forming an electromechanical transducer element for converting mechanical stress into electrical signals;

the transducer element comprising a transducer film element, a metal electrode layer for acting as an electrode, the electrode comprising an extension for electrically connecting the transducer to a printed circuitry board;

the method comprising the steps of:

(a) arranging the electrode layer on a first surface of the transducer film element;

(b) forming the electrode layer from a metal sheet so that a plurality of electrodes are formed from each metal sheet;

(c) forming plurality of transducer film elements from a sheet of transducer film by cutting it to preferred shape; and (d) gluing at least one of the plurality of electrodes and at least one of the plurality of transducer film elements together, so that the at least one of the plurality of transducer film elements glued to the at least one of the plurality of electrodes is spaced apart from another at least one of the plurality of transducer film elements glued to the at least one of the plurality of electrodes.

15. The method of forming an electromechanical transducer element according to claim 14, wherein the transducer element comprises a charged elastic electret film.

16. The method of forming an electromechanical transducer element according to claim 15, wherein the elastic electret film comprises a biaxially oriented foamed film layer comprising essentially flat gas bubbles.

17. The method of forming an electromechanical transducer element according to claim 16, further comprising the step of (e) swelling the biaxially oriented foamed film layers.

18. A method of forming an electromechanical transducer for converting mechanical stress into electrical signals, the electromechanical transducer having a transducer film element of elastic dielectric cellular electret film;

the method comprising the steps of:

(a) arranging at least a first electrode layer as signal electrode on a first surface of the transducer film element;

(b) arranging at least a second electrode layer as a ground electrode on a second surface of the transducer film element;

(c) arranging at least one boss one of proximal and partly onto one of the signal electrode and ground electrode; and (d) laminating under pressure the at least first and at least second electrode layer onto the transducer film element, so that areas of the at least first and at least second electrode layer encompassing the boss are more suppressed than areas not encompassing the boss of the at least first and at least second electrode layer.

19. The method of forming an electromechanical transducer element according to claim 18 further comprising the following step between step (c) and (d) the step comprising:

depositing a thick layer of one of isolating and electrode material one of proximal and partly onto one of the signal electrode and the ground electrode.

20. The method of forming an electromechanical transducer element according to claim 18 further comprising the following steps prior to the step (a), the step comprising printing a predetermined figure with an isolating material on a surface of metal used as one of the at least first and the at least second electrode layer;

removing the predetermined figure, after predetermined time, so that only part of the metal is corroded to form a hollowed area.

21. The method of forming an electromechanical transducer element according to claim 18, wherein step (d) comprises the step of compressing the transducer film element more onto areas not encompassing the boss of the at least first and at least second electrode layer than the areas of the at least first and at least second electrode layer encompassing the boss.

* * * * *